US009723675B2

(12) United States Patent
Lee et al.

(10) Patent No.: US 9,723,675 B2
(45) Date of Patent: Aug. 1, 2017

(54) DIMMING CIRCUIT

(71) Applicant: LG INNOTEK CO., LTD., Seoul (KR)

(72) Inventors: Jong Hyun Lee, Seoul (KR); Dong Keun Yoon, Seoul (KR); Jung Tae Kim, Seoul (KR); Shin Cho, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/215,894

(22) Filed: Jul. 21, 2016

(65) Prior Publication Data

US 2017/0027036 A1 Jan. 26, 2017

(30) Foreign Application Priority Data

Jul. 21, 2015 (KR) ..... 10-2015-0103026

(51) Int. Cl.
*H05B 37/02* (2006.01)
*H05B 33/08* (2006.01)

(52) U.S. Cl.
CPC ..... *H05B 33/0845* (2013.01)

(58) Field of Classification Search
CPC H05B 41/3925; H05B 41/2828; H05B 41/28; H05B 41/2827; H05B 41/285; H05B 37/029; H05B 33/0803; H05B 37/0254; H05B 37/02; H05B 33/0818
USPC ..... 315/185 R, 224, 291, 294, 312
See application file for complete search history.

(56) References Cited

U.S. PATENT DOCUMENTS

2012/0188487 A1* 7/2012 Hagino ..... H05B 33/0812 349/69
2013/0154487 A1* 6/2013 Kuang ..... H05B 33/0851 315/171

* cited by examiner

*Primary Examiner* — Minh D A
(74) *Attorney, Agent, or Firm* — LRK Patent Law Firm

(57) ABSTRACT

A dimming circuit includes an active dimmer configured to apply input power Vin to an amplification module or an error compensation module, the amplification module configured to amplify an output current of the active dimmer, and the error compensation module configured to correct an error or distortion of the amplification module. The amplification module and the error compensation module are connected in a feedback form.

6 Claims, 3 Drawing Sheets

DIMMING CIRCUIT

CROSS REFERENCE TO RELATED APPLICATION

The present application claims the benefit of Korean Patent Application No. 10-2015-0103026 filed in the Korean Intellectual Property Office on Jul. 21, 2015, the entire contents of which are incorporated herein by reference.

BACKGROUND OF THE INVENTION

1. Technical Field

The present invention relates to a dimming circuit including an active dimmer for applying input power Vin to an amplification module or an error compensation module, an amplification module for amplifying the output current of the active dimmer, and an error compensation module for correcting an error or distortion of the amplification module, wherein the amplification module and the error compensation module are connected in a feedback form.

2. Description of the Related Art

A light-emitting diode (LED) is a kind of semiconductor device for converting electric energy into light. An LED has advantages of low consumption power, a semi-permanent lifespan, a fast response speed, safety, and an eco-friendly property compared to existing light sources, such as a fluorescent lamp and an incandescent. In particular, an LED lamp device can perform various productions through control of the blinking sequence of a plurality of arranged LEDs, light-emitting color, and brightness.

A lot of research is being carried out in order to replace the conventional light sources with LEDs. An LED tends to be increasingly used as the light sources of lamp devices, such as various lamps used indoors, liquid crystal display devices, electric bulletin boards, and streetlamps. In particular, an LED is used as common lamps for indoor interior, a stage lamp for producing a specific atmosphere, an advertising lamp, and a view lamp.

A lamp is an elapse lamp and may be installed in an outer wall of a building, a park, a streetlamp, a bridge rail or a theater. The size and application system of a lamp may be different depending on use, a target or a location to which the lamp device is applied. That is, lamps for an outer wall of a building are installed in an outer wall of a building in a belt form and are used to simply display a single color or a combined color through a blinking function. Lamps for a park, a streetlamp or a bridge rail are irregularly installed depending on the shape of the subject and are used to change their blinking or colors.

An LED lamp has propagated rapidly due to a long lifespan and high efficiency compared to conventional lamps. A dimmer capable of changing luminous intensity in response to a change of weather and over time has been commercialized. The type of method for controlling such a dimmer may be divided into wireless communication and wired communication. In particular, wireless communication is used, brightness is controlled by adjusting a Dim (+−) line within each driver.

In particular, the dimming function of an LED lamp is widely used in various fields because it can be conveniently applied and has eco-friendly advantages. A 0-10V dimming method is used most widely. In this case, the 0-10V dimming method is divided into a passive method for controlling dimming light using a variable resistor and active method for controlling dimming light using a sink current. The active method is widely used because it has more excellent compatibility.

If a plurality of lamp devices is driven, however, a sink current for one lamp device is about 2 mA, but a maximum output current of an operational amplifier is about 10 mA. Accordingly, the active method has a disadvantage in that only a maximum of five lamp devices can be driven. Various researches are being carried out on a dimming circuit capable of driving a plurality of lamp devices at the same time or individually.

SUMMARY OF THE INVENTION

Embodiments of the present invention are directed to the provision of a dimming circuit configured to include an amplification module for amplifying the output current of an active dimmer so that a plurality of lamp devices can be controlled at the same time and to correct an error or distortion through an error compensation module as described above.

Technical objects to be achieved by the present invention are not limited to the object, and they may include various technical objects within the range evident to those skilled in the art from the following description.

A dimming circuit according to an embodiment of the present invention includes an active dimmer configured to apply input power Vin to an amplification module or an error compensation module, the amplification module configured to amplify an output current of the active dimmer, and the error compensation module configured to correct an error or distortion of the amplification module. The amplification module and the error compensation module are connected in a feedback form.

Furthermore, in the dimming circuit according to an embodiment of the present invention, the amplification module may control output power Vout so that the output power has the same value as the input power Vin of the active dimmer when the input power Vin is increased or decreased. Furthermore, the amplification module may include a push-pull amplifier or a class B amplifier.

Furthermore, in the dimming circuit according to an embodiment of the present invention, the amplification module may include a supply power source, a first transistor configured to perform a pull-down function, a second transistor configured to perform a pull-up function, a first resistor connected between a base B of the first transistor and an output terminal of the amplification module, and a second resistor connected between the output terminal and a base B of the second transistor. The emitters E the first transistor and the second transistor may be connected to the output terminal.

In this case, in the dimming circuit according to an embodiment of the present invention, the first transistor may include an npn BJT, and the second transistor may include a pnp BJT. Furthermore, the dimming circuit may further include a third resistor connected between the supply power source and the collector C of the first transistor.

In the dimming circuit according to an embodiment of the present invention, the error compensation module may include a comparator configured to receive the input power Vin of the active dimmer and the output power Vout at the output terminal of the amplification module and a first capacitor connected to the output terminal of the amplification module. In this case, the comparator may include an operational amplifier.

Furthermore, the dimming circuit according to an embodiment of the present invention may further include a fourth resistor configured to connect the amplification module and the error compensation module, and may further include a driver configured to receive the output power Vout from the amplification module.

DETAILED DESCRIPTION

Hereinafter, a "dimming circuit" according to an embodiment of the present invention is described in detail with reference to the accompanying drawings. Embodiments to be described are provided in order for those skilled in the art to easily understand the technical spirit of the present invention, and the present invention is not restricted by the embodiments. Furthermore, contents represented in the accompanying drawings have been diagrammed in order to easily describe the embodiments of the present invention, and the contents may be different from forms that are actually implemented.

Elements to be described herein are only examples for implementing the embodiments of the present invention. Accordingly, in other implementations of the present invention, different elements may be used without departing from the spirit and scope of the present invention.

Furthermore, an expression that some elements are "included" is an expression of an "open type", and the expression simply denotes that the corresponding elements are present, but should not be construed as excluding additional elements.

Furthermore, expressions, such as "the first" and "the second", are expressions used to only distinguish a plurality of elements from one another, and do not limit the sequence of the elements or other characteristics.

Furthermore, in the embodiments of the present invention, "power" may include all of kinds of electric energy which may be used in common electrical circuits, such as "voltage", "electric power", and "current."

Figure 1:
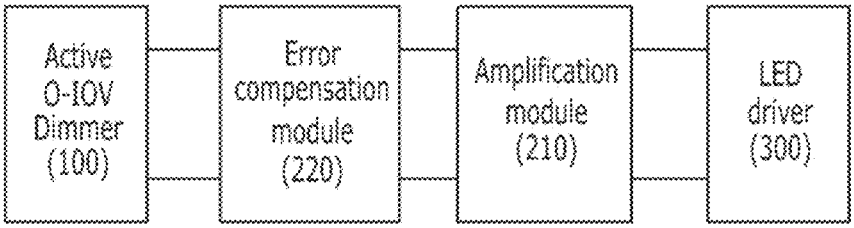
FIG. 1 shows the configuration of a dimming circuit according to an embodiment of the present invention.
Figure 2:
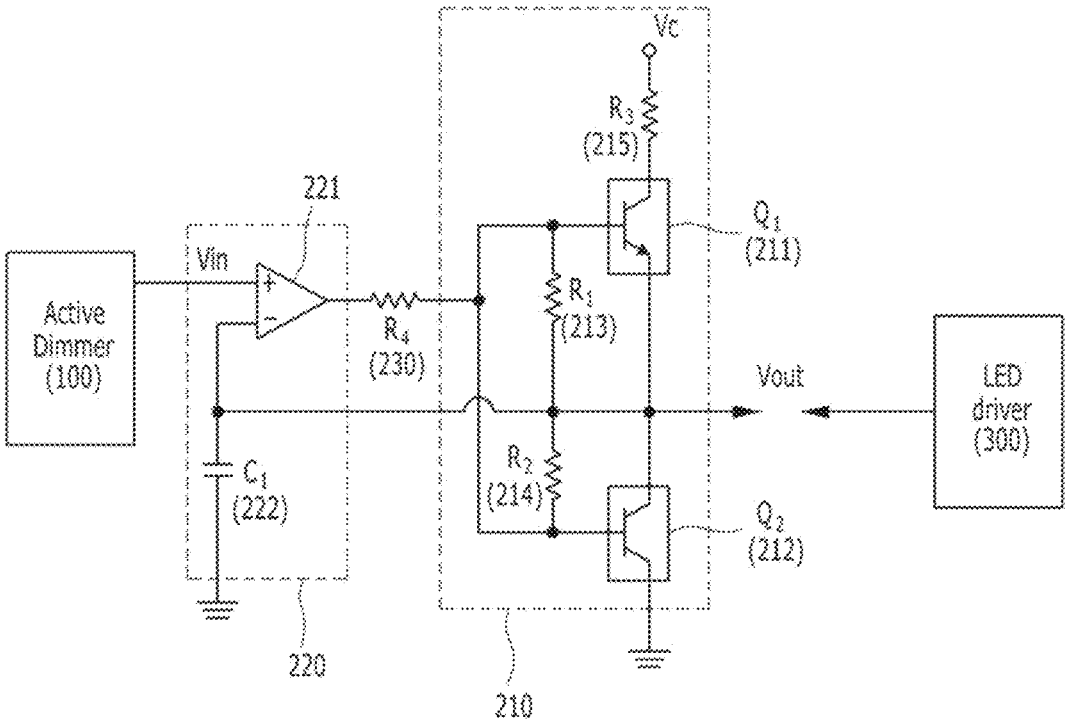
FIG. 2 is a circuit diagram showing the dimming circuit according to an embodiment of the present invention.

FIG. 1 shows the configuration of a dimming circuit according to an embodiment of the present invention. FIG. 2 is a circuit diagram showing the dimming circuit according to an embodiment of the present invention.

Referring to FIG. 1, the dimming circuit according to an embodiment of the present invention may include an active dimmer 100, an amplification module 210, and an error compensation module 220.

The active dimmer 100 may apply input power Vin to the amplification module or the error compensation module. The active dimmer receives a dimming signal from an external terminal, generates a lamp control signal, and transmits the lamp control signal to a driver. The active dimmer performs control using a sink current.

The amplification module 210 amplifies the output current of the active dimmer 100. In this case, if the input power Vin of the active dimmer 100 is increased or decreased, the amplification module 210 may adjust output power Vout so that it has the same value as the input power Vin. The amplification module 210 may include a push-pull amplifier or a class B amplifier.

The amplification module 210 may amplify a sink current through a transistor using a dimming signal of 0-10 V using a push-pull circuit, and may drive a plurality of lamp devices. Elements forming the amplification module are described in detail later with reference to FIG. 2.

The error compensation module 220 corrects an error or distortion of the amplification module 210. The amplification module used in the dimming circuit according to an embodiment of the present invention may have an error because it uses various types of elements, such as a plurality of transistors, resistors, and a parasitic capacitor, and may have a cross-over distortion in the structure of a push-pull amplifier circuit or a class B amplifier circuit. Accordingly, an error in the normal state of input power and output power can be corrected using negative feedback by connecting the error compensation module including a comparator 221 and a first capacitor 222 to the amplification module in a feedback form.

A driver 300 receives the output power Vout from the output terminal of the amplification module 210 and controls a lamp. In this case, the driver may control an LED lamp. The driver is connected to the lamp and may turn on/off the lamp or adjust luminous intensity of the lamp in response to a lamp control signal.

Referring to FIG. 2, the amplification module 210 according to an embodiment of the present invention may include a supply power source Vc, a first transistor Q1; 211, a second transistor Q2; 212, a first resistor R1; 213, and a second resistor R2; 214.

The supply power source Vc supplies consumption power to the first transistor or the second transistor. In general, a power source of 12 V may be used as the supply power source Vc.

The first transistor Q1; 211 performs a pull-down function. The second transistor Q2; 212 performs a pull-up function. Furthermore, the emitters E of the first transistor 211 and the second transistor 212 are connected to the output terminal of the amplification module 210. The first transistor is an npn BJT, and the second transistor is a pnp BJT.

A push-pull circuit performs a single function using two elements having opposite properties. Accordingly, during one half cycle of one cycle, one element operates, but the other element stops operating. During the other half cycle of one cycle, one element stops operating, but the other element operates. As a result, a complementary function in which the first transistor performs a pull-down function and the second transistor performs a pull-up function can be performed.

The first resistor R1; 213 is connected between the base B of the first transistor 211 and the output terminal of the amplification module. The second resistor R2; 214 is connected between the base B of the second transistor 212 and the output terminal of the amplification module. Furthermore, the third resistor R3; 215 may be connected between the supply power source Vc and the collector C of the first transistor 211. The currents of the first transistor 211 and the second transistor 212 can be controlled through the third resistor 215.

The error compensation module 220 may include the comparator 221 and the first capacitor 222.

The comparator 221 receives the input power Vin of the active dimmer 100 and the output power Vout of the amplification module 210. The dimming circuit according to an embodiment of the present invention functions to have output voltage follow input voltage when the input voltage is applied. Accordingly, the dimming circuit functions to compare an input voltage with an output voltage through the comparator, to detect a change of the input voltage when the input voltage is changed, and to make the output voltage identical with the input voltage. In this case, the comparator includes an operational amplifier (OP-AMP).

The first capacitor 222 is connected to the output terminal of the amplification module. In this case, the first capacitor may function to remove noise in the entire circuit.

A fourth resistor R4; 230 connects the amplification module 210 and the error compensation module 220. The base currents of the first transistor and the second transistor can be controlled through the fourth resistor 230.

Figure 3:
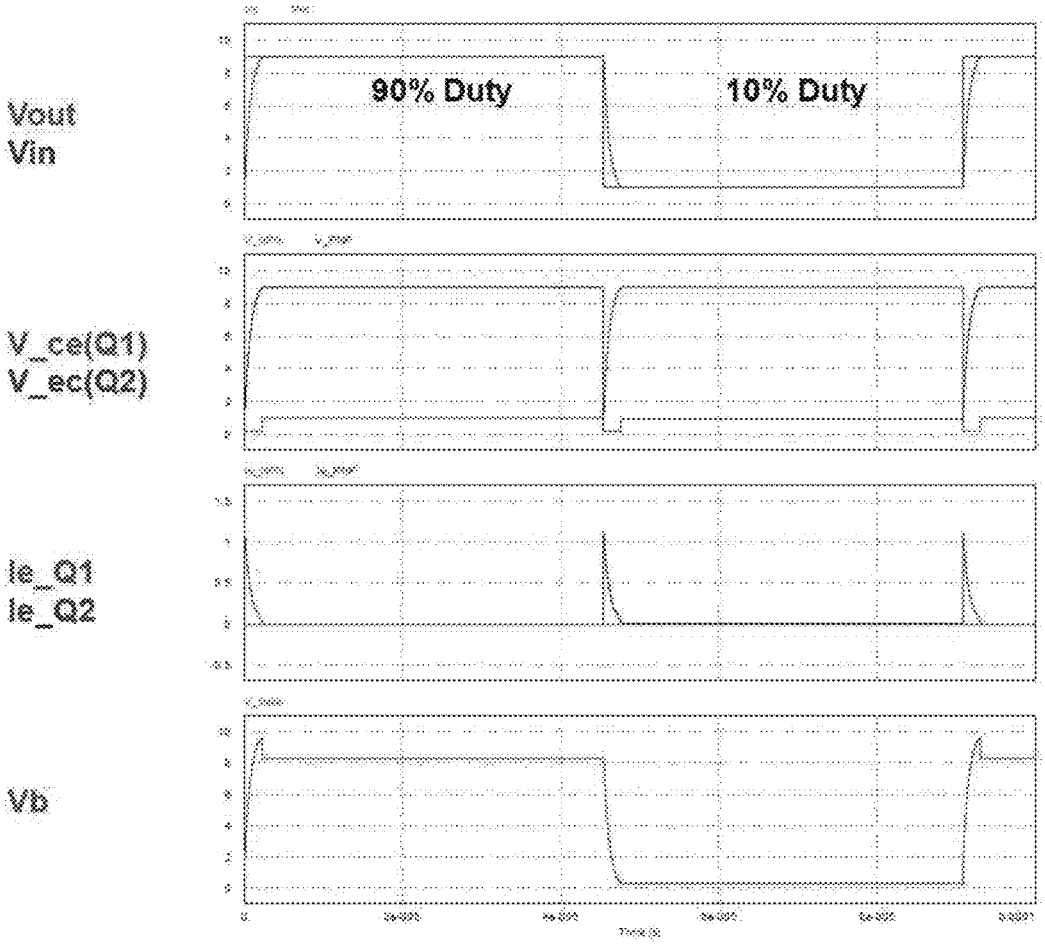
FIG. 3 is a graph showing an increase and a decrease when the dimming circuit according to an embodiment of the present invention controls a lamp.

FIG. 3 is a graph showing an increase and a decrease when the dimming circuit according to an embodiment of the present invention controls a lamp.

In an embodiment of the present invention, when the value of the input power Vin (i.e., a dimming signal of 0-10 V) rises, the Vb (i.e., a base voltage) value of the first transistor rises. If a difference between the voltages Vbe (i.e., base and emitter voltages) of the first transistor is 0.7 V or more, the first transistor conducts and thus an emitter current Ie flows. Accordingly, the output voltage Vout rises and continues to rise until it becomes identical with the input voltage Vin. In this case, the second transistor does not operate.

Furthermore, when the value of the input power Vin drops, the Vb value of the second transistor drops. When a difference between the voltages Vbe of the second transistor is −0.7 V or less, the second transistor conducts and thus the emitter current Ie flows. Accordingly, the output voltage Vout is decreased and continues to decrease until it becomes identical with the input voltage Vin. In this case, the first transistor does not operate.

From the first graph of FIG. 3, it may be seen that the output power Vout rises from 0 V to 9 V when the input power Vin of 9 V is applied and the output power Vout drops from 9 V to 1 V when the input power Vin of 1 V is applied. Furthermore, the remaining graphs of FIG. 3 show a change of the collector-emitter voltages of the first transistor and the second transistor, a change of the emitter current, and a change of the base voltage.

The dimming circuit according to an embodiment of the present invention includes the amplification module for amplifying the output current of the active dimmer so that a plurality of lamp devices can be controlled at the same time, and can correct an error or distortion through the error compensation module.

Furthermore, the dimming circuit according to an embodiment of the present invention can control a plurality of LED lamps at the same time using a current amplifier if a circuit capable of controlling the plurality of LED lamps at the same time is to be implemented, and can precisely control a dimming signal by connecting the amplification module and the error compensation module in a feedback form.

Furthermore, the dimming circuit according to an embodiment of the present invention can amplify the sink current of the active dimmer so that a plurality of lamp devices can be driven at the same time because the first transistor and the second transistor complementarily operate due to the characteristics of the push-pull circuit.

Furthermore, the dimming circuit according to an embodiment of the present invention can be used in the PCB space easily because a cost is reduced and the size of parts is reduced and can effectively control various types of lamps used in buildings and residence environments because it can control various types of lamps identically or differently through dimming control.

The aforementioned embodiments of the present invention have been disclosed for illustrative purposes, and the present invention is not restricted by the embodiments. Furthermore, those skilled in the art to which the present invention pertains may modify and change the present invention in various ways within the spirit and scope of the present invention, and such modifications and changes should be construed as belonging to the scope of the present invention.

What is claimed is:

1. A dimming circuit comprising:

an active dimmer configured to apply input power Vin to an amplification module or an error compensation module;

the amplification module configured to amplify an output current of the active dimmer; and the error compensation module configured to correct an error or distortion of the amplification module, wherein the amplification module and the error compensation module are connected in a feedback form, wherein the amplification module comprises:

a supply power source;

a first transistor configured to perform a pull-down function;

a second transistor configured to perform a pull-up function;

a first resistor connected between a base of the first transistor and an output terminal of the amplification module; and a second resistor connected between the output terminal and a base of the second transistor, and wherein emitters of the first transistor and the second transistor are connected to the output terminal.

2. The dimming circuit of claim 1, wherein:

the first transistor comprises an npn BJT, and the second transistor comprises a pnp BJT.

3. The dimming circuit of claim 1, further comprising a third resistor connected between the supply power source and a collector of the first transistor.

4. A dimming circuit comprising:

an active dimmer configured to apply input power Vin to an amplification module or an error compensation module;

the amplification module configured to amplify an output current of the active dimmer; and the error compensation module configured to correct an error or distortion of the amplification module, wherein the amplification module and the error compensation module are connected in a feedback form, and wherein the error compensation module comprises:

a comparator configured to receive the input power Vin of the active dimmer and output power Vout at an output terminal of the amplification module; and a first capacitor connected to the output terminal of the amplification module.

5. The dimming circuit of claim 4, wherein the comparator comprises an operational amplifier.

6. A dimming circuit comprising:

an active dimmer configured to apply input power Vin to an amplification module or an error compensation module;

the amplification module configured to amplify an output current of the active dimmer;

the error compensation module configured to correct an error or distortion of the amplification module; and a fourth resistor configured to connect the amplification module and the error compensation module, wherein the amplification module and the error compensation module are connected in a feedback form.

* * * * *